US006581917B2

(12) United States Patent
Mulvaney

(10) Patent No.: US 6,581,917 B2
(45) Date of Patent: Jun. 24, 2003

(54) SENSOR ASSEMBLY AND METHOD FOR DETERMINING CONDITION OF WICKS IN HUMIDIFIERS

(75) Inventor: Patrick T. Mulvaney, Glen Allen, VA (US)

(73) Assignee: Hamilton Beach/Proctor-Silex, Inc., Glen Allen, VA (US)

( * ) Notice: Subject to any disclaimer, the term of this patent is extended or adjusted under 35 U.S.C. 154(b) by 0 days.

(21) Appl. No.: 10/078,991

(22) Filed: Feb. 19, 2002

(65) Prior Publication Data

US 2002/0113328 A1 Aug. 22, 2002

Related U.S. Application Data

(60) Provisional application No. 60/269,991, filed on Feb. 19, 2001.

(51) Int. Cl.[7] ..... B01F 3/04
(52) U.S. Cl. ..... 261/107; 261/DIG. 65
(58) Field of Search ..... 261/72.1, 107, 261/DIG. 65

(56) References Cited

U.S. PATENT DOCUMENTS 5,800,741 A 9/1998 Glenn et al.
5,903,223 A 5/1999 Howell
6,237,899 B1 5/2001 Offir et al.

FOREIGN PATENT DOCUMENTS

JP 62153637 A * 7/1987 ..... 261/107

* cited by examiner

*Primary Examiner*—Robert A. Hopkins
(74) *Attorney, Agent, or Firm*—Akin, Gump, Strauss, Hauer & Feld, L.L.P.

(57) ABSTRACT

A sensor assembly for determining a condition of a wick in an evaporative humidifier includes one or more temperature sensors for detecting temperatures at measurement locations along the wick, and circuitry in communication with the one or more sensors for determining a temperature differential between adjacent measurement locations. The circuitry generates at least one signal indicative of the condition of the wick when the temperature differential is above a predetermined value.

21 Claims, 2 Drawing Sheets

SENSOR ASSEMBLY AND METHOD FOR DETERMINING CONDITION OF WICKS IN HUMIDIFIERS

CROSS-REFERENCE TO RELATED APPLICATIONS

This application claims the benefit of U.S. Provisional Application No. 60/269,991 filed on Feb. 19, 2001, the disclosure of which is hereby incorporated by reference.

BACKGROUND OF THE INVENTION

This invention relates to evaporative humidifiers, and more particularly to an apparatus and method for sensing the level of water absorbed within a wick and for indicating the efficiency of the wick.

Humidifiers are often used in environments where it is desirous to raise the level of humidity, particularly in homes or the like during the winter months where the relative humidity may be reduced to an uncomfortable level by the heating system. Under these circumstances, it is beneficial to introduce moisture into the air. Humidifiers of the evaporative type are commonly used for this purpose. Such humidifiers typically include a housing with a reservoir for holding water, a water absorbing material, such as a wick, partially submerged in the water, and a fan attached to the housing for creating airflow through the wick. In use, water is drawn up through the non-immersed portion of the wick by capillary action while airflow through the wick distributes the moisture from the wick to the surrounding atmosphere.

Over time, the wick's ability to draw water from the reservoir deteriorates, leading to less efficient operation of the humidifier. Accordingly, the wick must be replaced in order to restore the humidifier's efficiency. Prior attempts to determine the wick's condition have included physical inspection of the wick and/or monitoring the time period during which the wick is in use. However, it is difficult to determine when the wick should be replaced since these techniques do not assess the actual performance of the wick. By way of example, the wick may change color as a result of the absorption of various minerals over a period of a time. Since the minerals that exist in public or private water supplies can vary from one location to another, replacement guidelines based only on physical inspection and/or time in use fail to adequately assess the condition of the wick and/or its efficiency.

BRIEF SUMMARY OF THE INVENTION

According to one aspect of the invention, a humidifier comprises a reservoir adapted to retain water, an evaporative media in fluid communication with the reservoir, and at least one sensor for detecting temperatures at a plurality of measurement locations along the length of the evaporative media. The evaporative media is adapted to draw water along a length thereof from the reservoir. The humidifier also comprises a controller that is in communication with the at least one sensor for determining a temperature differential between adjacent measurement locations along the length of the evaporative media. The controller generates at least one signal indicative of at least one of evaporative media replacement and evaporative media remaining life when the temperature differential is above a predetermined value.

According to a further aspect of the invention, a sensor assembly for determining a condition of a wick in an evaporative humidifier comprises at least one sensor for detecting temperatures at measurement locations along the wick, and circuitry in communication with the at least one sensor for determining a temperature differential between adjacent measurement locations. The circuitry generates at least one signal indicative of the condition of the wick when the temperature differential is above a predetermined value.

According to an even further aspect of the invention, a method of determining a condition of a wick in an evaporative humidifier comprises measuring a plurality of temperature values at a corresponding plurality of measurement locations along the wick, calculating at least one temperature differential from adjacent temperature values corresponding to adjacent measurement locations, and generating at least one signal indicative of at least one of wick replacement and wick remaining life when the temperature differential is above a predetermined value.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown.

In the drawings.

DETAILED DESCRIPTION OF THE INVENTION

Figure 1:
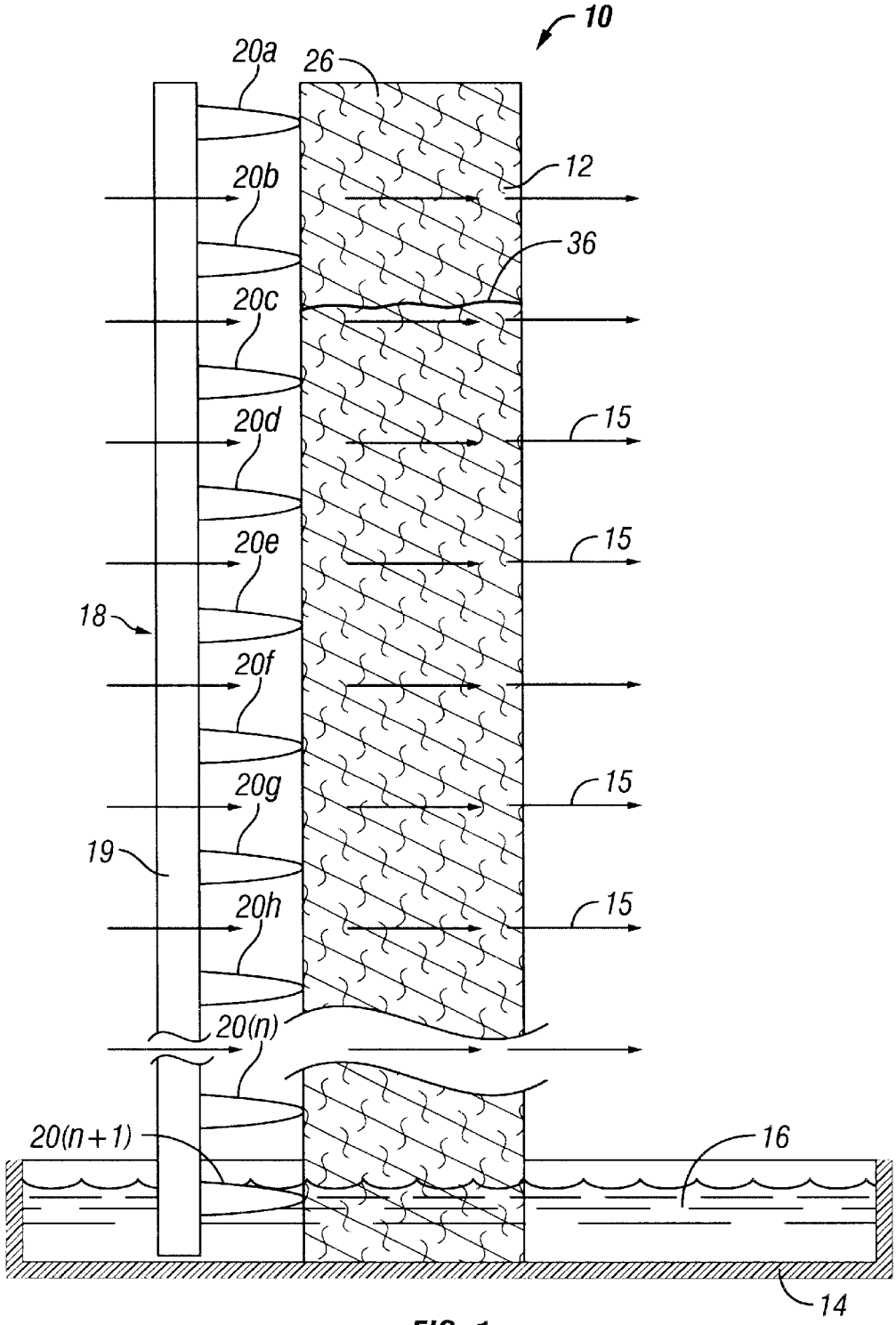
FIG. 1 is a cross-sectional view in partial schematic of a sensor assembly in accordance with the present invention as applied to a wick positioned in fluid communication with a reservoir.

Referring now to the drawings, and to FIG. 1 in particular, a conventional evaporative humidifier 10 is shown together with a sensor assembly 18 in accordance with the present invention. The conventional evaporative humidifier 10 includes a reservoir 14, a wick 12 that extends upwardly from the reservoir 14, and a blower assembly (not shown) of the type well known in the art that draws or pushes air, represented by arrows 15, through the wick 12. Water 16 is retained within the reservoir and is absorbed upwardly into the wick 12 through capillary action.

The water 16 absorbed in the wick 12 undergoes a phase change from liquid to vapor as it absorbs the heat of vaporization from the air passing through the wick 12. Therefore, the temperature of portions of the wick 12 that evaporate water adsorbed therein will be less than that of ambient air entering the humidifier 10. If the water 16 is not effectively evaporated from a portion of the wick 12, then such a portion will have a temperature approximating that of the ambient air entering the humidifier 10.

The sensor assembly 18 in accordance with the present invention is preferably positioned in proximity to the wick 12 for measuring a plurality of temperatures along the wick. The sensor assembly 18 preferably includes a vertically extending support 19 and a plurality of sensors 20 that are vertically positioned on the support 19 in spaced relation to each other. The support 19 is preferably relatively narrow in profile as compared to the wick 12, so that air may freely flow around the support 19. Each sensor 20 can comprise a conventional thermistor or other temperature sensing device.

Figure 2:
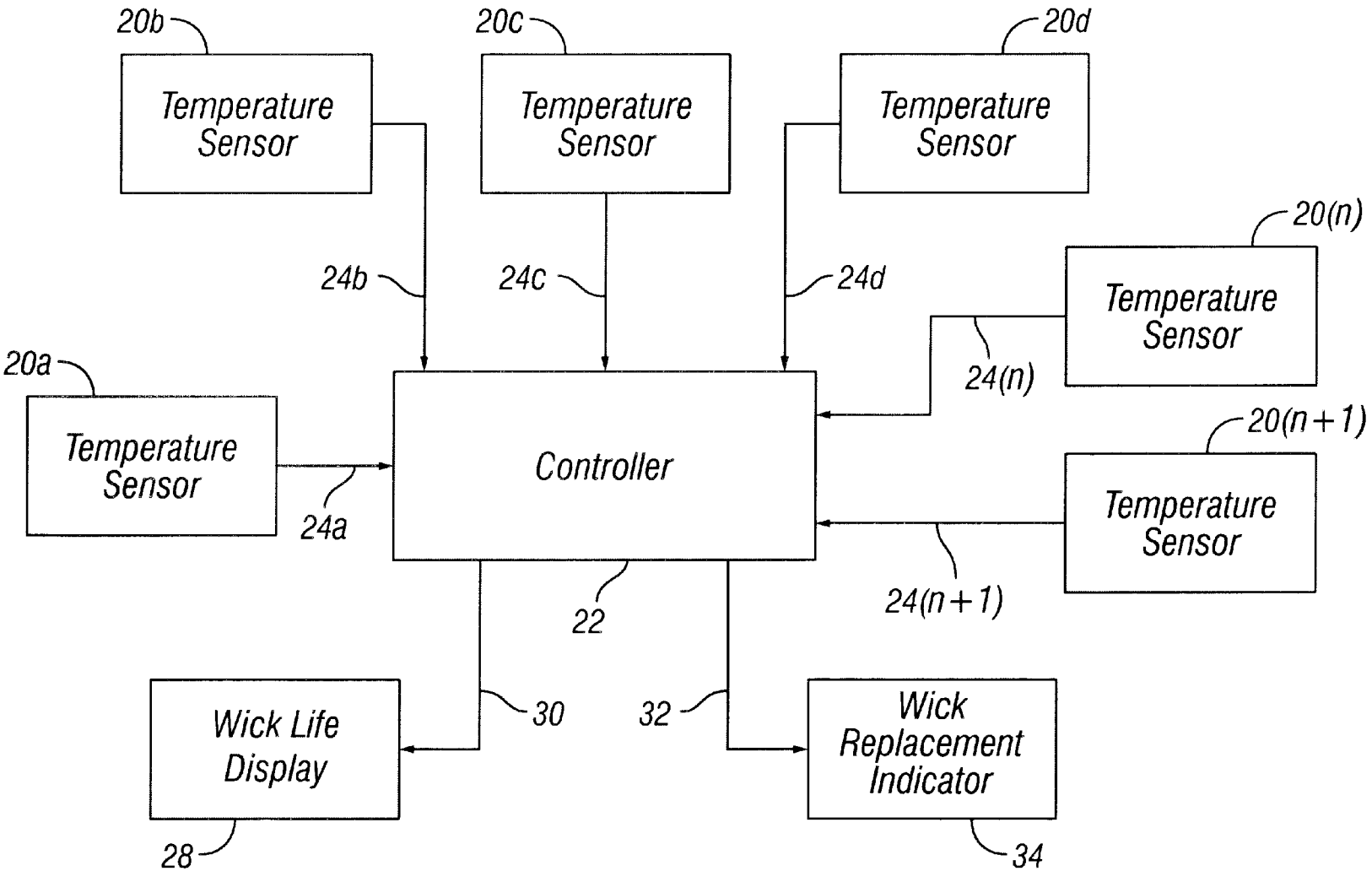
FIG. 2 is a block diagram illustrating a system for determining the condition of a wick in accordance with the present invention.

As shown in FIG. 2, the sensors 20 are in communication with a controller 22 for providing a temperature signal 24 thereto. The controller 22 may be either digital or analog and, as such, may include a microprocessor and/or control circuitry. As detailed below, the controller 22 analyzes and compares a plurality of temperature signals 24 received at any instant in time to determine if a temperature differential (ΔT) exists between any two adjacent sensors 20.

With further reference to FIG. 1, each temperature sensor 20 is identified with a reference numeral followed by a letter wherein sensor 20*a* is the uppermost positioned sensor and sensor 20(*n*+1) is the lowermost positioned sensor.

Each sensor 20*a*, 20*b*, 20*c*, 20*d*, . . . 20*n*, and 20(*n*+1) provides a signal 24*a*, 24*b*, 24*c*, 24*d*, . . . 24*n*, and 24(*n*+1), respectively, to the controller 22 representative of a temperature Ta, Tb, Tc, Td, . . . Tn, and T(n+1 ), respectively, at the vertically positioned locations on the wick 12. It should be noted that the plurality of sensors 20 may be replaced by a single sensor, such as a non-contact infrared sensor, for detecting temperatures at the plurality of locations on the wick 12.

A new wick 12 will have approximately the same temperature over its length when the water 16 is drawn to a top 26 of the wick 12. Therefore, the difference between the temperatures measured by the temperature sensors 20 at any two adjacent locations along the wick 12 will be substantially equal to a predetermined value x, which is typically approximately equal to zero. However, it should be appreciated that the value of x may vary by several degrees Fahrenheit due to environmental conditions, such as differing air flows along the wick 12.

As the wick 12 ages, the water 16 will not be drawn to a top 26 of the wick 12 and a first temperature differential (ΔT1) between the uppermost locations as measured by sensor 20*a* and sensor 20*b* will increase, since evaporative cooling will not take place in the region of the wick 12 measured by the sensor 20*a*. As the wick 12 continues to age, the water 16 will no longer be drawn to the height of sensor 20*b*, therefore a second temperature differential (ΔT2) between temperatures measured by sensor 20*b* and sensor 20*c* will increase. This process of wick aging will continue with the temperature differential (ΔTn) between temperatures measured by 20(*n*) and 20(*n*+1).

The location of the temperature differential (ΔT) can be used as an indicator of wick life and can also be used as a replacement indicator. More particularly, the controller 22 analyzes the current location of the temperature differential (ΔT) to determine wick life which may be transmitted to a wick life display 28 through a signal 30. Likewise, when the temperature differential (ΔT) drops below a predetermined position between a pair of sensors 20, the controller 22 may send a wick replacement signal 32 to a wick replacement indicator 34.

As illustrated in FIG. 1, during normal continued operation of a humidifier 10 with water absorbed to the top 26 of the wick 12, such as when a new wick is used, all temperatures as measured by the sensors 20 are substantially equal, resulting in temperature differentials substantially equal to a predetermined value x, which is usually equal to zero under ideal conditions:

$$Ta-Tb=Tb-Tc=Tc-Td \ldots T(n)-T(n+1)\approx x$$

However, when the wick 12 ages such that water 16 drawn by the wick 12 drops below the sensor 20*b* but above the sensor 20*c*, as indicated by absorption level line 36 in FIG. 1, then:

$$Ta-Tb<Tb-Tc>Tc-Td=\ldots T(n)-T(n+1)$$

wherein:

Ta−Tb≈x

Tb−Tc>x

Tc−Td≈x

.

.

.

T(n)−T(n+1)≈x

Thus, based on the temperatures sensed along the length of the wick 12, the controller 22 can determine the approximate height or point above which the wick will not absorb or draw water, in this example above the level of temperature sensor 20*b*, and therefore determine the useful remaining wick life as well as the wick efficiency. By way of example, it may be determined that the wick should be replaced when the efficiency of the wick is at 50%, e.g. the wick will not absorb or draw water above half the length of the wick. In this instance, the remaining wick life may be determined by comparing the current position of differential temperature (ΔT) with a predetermined position or a wick replacement position. Accordingly, the controller 22 can send a signal 30 to the wick life display 28 to indicate the remaining life of the wick. The display 28 can take several forms including, but not limited to, alphanumeric displays, one or more LED's, bargraph displays, icons, and so on. In this example, when it is determined that the location of the current temperature differential (ΔT) is approximately equal to the predetermined position, such as the half height of the wick, then a signal 32 is sent to the wick replacement indicator 34, which may be in the form of an alphanumeric display, one or more LED's, a bargraph display, an icon, and so on. It will be understood that other positions along the length of the wick can be used for determining wick efficiency and/or wick replacement.

It will be appreciated by those skilled in the art that changes could be made to the embodiments described above without departing from the broad inventive concept thereof. By way of example, although a plurality of temperature sensors are preferably used for determining a temperature differential at a plurality of locations along the wick, it will be understood that a single pair of temperature sensors can be positioned at predefined spaced locations at or near the wick replacement height or location to thereby indicate when the wick should be replaced, without necessarily indicating remaining wick life. Moreover, although the temperature sensors have been shown in contact with an outer surface of the wick, it will be understood that the temperature sensors can be positioned at any location along the thickness of the wick. It will be understood, therefore, that this invention is not limited to the particular embodiments disclosed, but it is intended to cover modifications within the spirit and scope of the present invention as defined by the appended claims.

I claim:

1. A humidifier comprising:

a reservoir adapted to retain water;

an evaporative media in fluid communication with the reservoir, the evaporative media being adapted to draw water along a length thereof from the reservoir;

at least one sensor for detecting temperatures at a plurality of measurement locations along the length of the evaporative media; and a controller in communication with the at least one sensor for determining a temperature differential between adjacent measurement locations along the length of the evaporative media and for generating at least one signal indicative of at least one of evaporative media replacement and evaporative media remaining life when the temperature differential is above a predetermined value.

2. A humidifier according to claim 1, wherein the controller determines a location of the temperature differential above the predetermined value along the length of the evaporative media.

3. A humidifier according to claim 2, wherein the controller generates the at least one signal indicative of the evaporative media remaining life based on a distance between the temperature differential location and a predetermined location on the evaporative media.

4. A humidifier according to claim 3, wherein the controller generates the at least one signal indicative of evaporative media replacement when the temperature differential location is approximately equal to the predetermined location.

5. A humidifier according to claim 2, wherein the controller generates the at least one signal indicative of evaporative media replacement when the temperature differential location is approximately equal to a predetermined location on the evaporative media.

6. A humidifier according to claim 1, wherein the at least one sensor comprises a plurality of temperature sensors positioned at the plurality of locations.

7. A humidifier according to claim 6, wherein the controller is in communication with the plurality of temperature sensors for determining temperature differentials between the adjacent measurement locations.

8. A humidifier according to claim 1, and further comprising at least one display connected to the controller for indicating at least one of replacement and remaining life of the evaporative media.

9. A sensor assembly for determining a condition of a wick in an evaporative humidifier, the sensor assembly comprising:

at least one sensor for detecting temperatures at measurement locations along the wick; and circuitry in communication with the at least one sensor for determining a temperature differential between adjacent measurement locations and generating at least one signal indicative of the condition of the wick when the temperature differential is above a first predetermined value.

10. A sensor assembly according to claim 9, wherein the at least one sensor comprises a temperature sensor positioned at each of the measurement locations.

11. A sensor assembly according to claim 9, wherein the circuitry determines a location of the temperature differential along the wick.

12. A sensor assembly according to claim 11, wherein the circuitry generates a signal indicative of wick remaining life when a distance between a location of the temperature differential and a predetermined location on the wick exceeds a second predetermined value.

13. A sensor assembly according to claim 12, wherein the circuitry generates a wick replacement signal when the temperature differential location is approximately equal to the predetermined location.

14. A sensor assembly according to claim 11, wherein the circuitry generates a signal indicative of wick replacement when the temperature differential location is approximately equal to a predetermined location along the wick.

15. A humidifier according to claim 9, and further comprising at least one display connected to the circuitry for indicating the condition of the wick based on the at least one signal.

16. A method of determining a condition of a wick in an evaporative humidifier, the method comprising:

measuring a plurality of temperature values at a corresponding plurality of measurement locations along the wick;

calculating at least one temperature differential from adjacent temperature values corresponding to adjacent measurement locations; and generating at least one signal indicative of at least one of wick replacement and wick remaining life when the temperature differential is above a predetermined value.

17. A method according to claim 16, and further comprising determining a position of the temperature differential along the wick.

18. A method according to claim 17, wherein the at least one signal is generated for wick remaining life by comparing the temperature differential position with a predetermined position on the wick.

19. A method according to claim 18, wherein the at least one signal is generated for wick replacement when the temperature differential position is approximately equal to the predetermined position.

20. A method according to claim 17, wherein the at least one signal is generated for wick replacement when the temperature differential location is approximately equal to a predetermined location on the evaporative media.

21. A method according to claim 16, and further comprising displaying at least one of wick replacement and wick remaining life based on the at least one generated signal.

* * * * *